United States Patent [19]

Rochte

[11] Patent Number: 4,637,941

[45] Date of Patent: Jan. 20, 1987

[54] SEGMENTED GEOMETRIC STRUCTURE

[76] Inventor: Randall S. Rochte, 5925 Finecrest Dr., Rancho Palos Verdes, Calif. 90274

[21] Appl. No.: 693,104

[22] Filed: Jan. 22, 1985

[51] Int. Cl.[4] ..... A63H 33/40; B44C 3/08; G09F 21/00

[52] U.S. Cl. ..... 428/8; D11/141; 29/456; 52/81; 52/646; 156/143; 156/196; 156/245; 264/318; 264/339; 362/806; 428/11; 428/371; 428/542.6

[58] Field of Search ..... D11/141; D20/16; D21/94; 156/143, 156, 64, 196, 245, 242, 250; 264/319, 339, 318; 428/7, 8, 11, 542.2, 542.4, 542.6, 371; 261/DIG. 72; 52/646, 80–81; 29/456; 362/806; 267/92, 168

[56] References Cited

U.S. PATENT DOCUMENTS

| | | | |
|---|---|---|---|
| D. 63,118 | 10/1923 | Costanz | D20/16 X |
| D. 80,452 | 2/1930 | Parchman | D20/16 |
| D. 116,815 | 9/1939 | Darcey | 428/7 X |
| D. 261,631 | 11/1981 | Immel | D11/141 X |
| 2,951,303 | 9/1960 | Hovlid | 428/8 X |
| 3,054,209 | 9/1962 | Wiley, Jr. | 428/7 X |
| 3,546,049 | 12/1970 | Kostich | 428/11 X |
| 3,549,465 | 12/1970 | Skelley, Jr. | 428/11 |
| 4,062,543 | 12/1977 | Loeffler | D21/94 X |
| 4,174,989 | 11/1979 | Skakunov et al. | 428/542.2 X |
| 4,214,747 | 7/1980 | Rebajes | 428/7 X |

FOREIGN PATENT DOCUMENTS

| | | | |
|---|---|---|---|
| 842750 | 5/1970 | Canada | 428/371 |
| 1137031 | 1/1957 | France | 428/11 |
| 768252 | 2/1957 | United Kingdom | 428/12 |
| 827400 | 2/1960 | United Kingdom | 428/9 |

*Primary Examiner*—Henry F. Epstein
*Attorney, Agent, or Firm*—Albert O. Cota

[57] ABSTRACT

A segmented geometric structure that when rotated serves as a functional mood-setting device or simply as a static or rotatable object d'art. The structure is comprised of a plurality of spirally formed curvilinear segments that are joined at their respective top and bottom to form a single rigid structure. The structure may take the form of a spheroid, ellipsoid or any other three-dimensional geometric form amenable to a segmented construction. The structure is suspended by means of a suspension line that is attached to an elevated support or a shaft may be attached to either the top or bottom end of the structure. The other end of the shaft is attached to a reversible electrical motor that is housed within a mounting base. When the structure is rotated, either manually or by the motor, in a clockwise direction the segments appear to move spirally upwards conversely when rotated in a counter clockwise direction the segments appear to move spirally downward.

15 Claims, 12 Drawing Figures

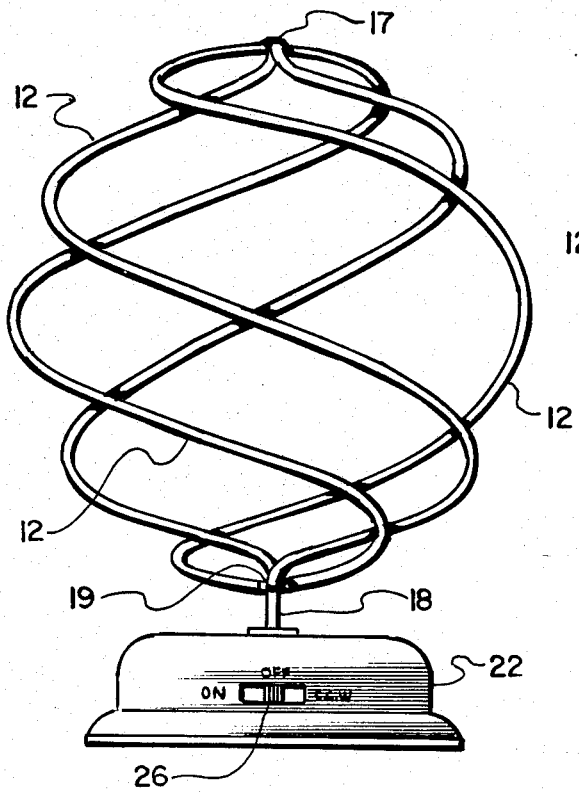
Fig.4.
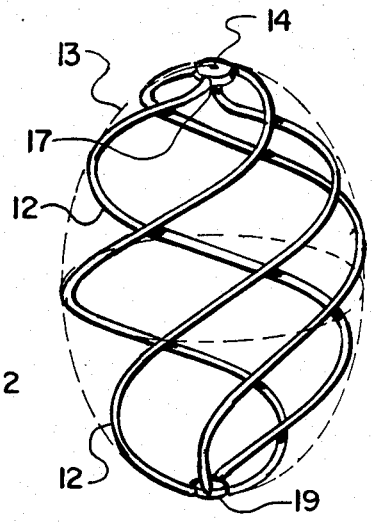
Fig.5.
Fig.6.
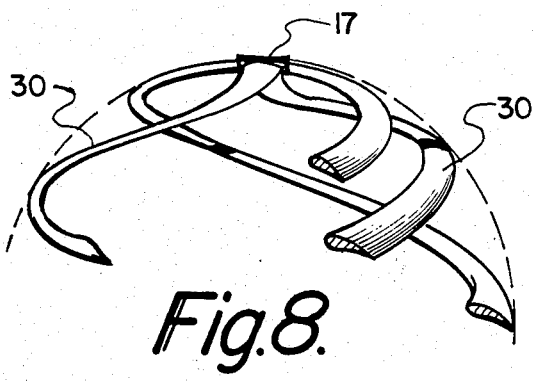
Fig.8.
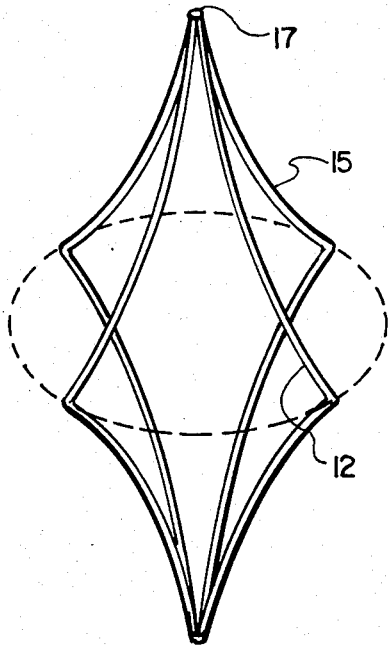
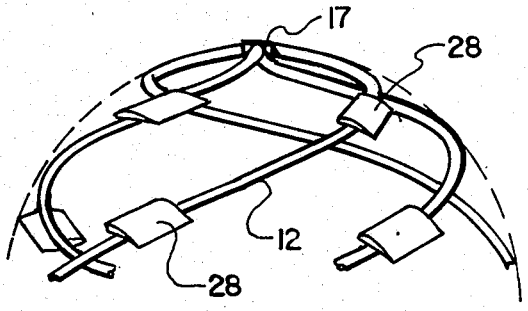
Fig.7.

SEGMENTED GEOMETRIC STRUCTURE

TECHNICAL FIELD

The invention pertains to the general field of three-dimensional, geometric structures and more particularly to a rotatable, three-dimensional, geometric structure rigidly constructed from a plurality of spirally wound curvilinear segments.

BACKGROUND ART

Suspended and rotatable geometric structures have been produced in a variety of shapes, constructions and have found usefulness in a variety of ways including display advertising, visual effects, and simply as objects d'art. The majority of these prior art structures employing rigid segments to form the geometric structure are usually of simple designs. These designs primarily utilize a construction method that employs a plurality of smaller linear segments that are attached together to thus form a larger segmented geometric structure in the shape of spheroid, ellipsoid or, a derivative thereof. Continuous curvilinear sections are not generally used because of the design difficulties in deriving a set of symetrical curves and the cost of manufacturing such segments.

A search of the prior art did not disclose any patents that read directly on the claims of the instant invention. However, the following U.S. patents are considered related and indicative of the state-of-the art:

| PATENT NUMBER | INVENTOR | ISSUED |
|---|---|---|
| 768,252 (UK) | Sessions et al | 13 February 1957 |
| 80,452 (Design) | Parchmann | 4 February 1930 |
| 63,118 (Design) | Costanz | 9 October 1923 |

The Sessions patent discloses a device that is suspended from a support and that is produced from a single sheet of material in such a manner that it can be collapsed into a flat package for storage or transport. The device which is adapted to be rotated by air currents when suspended is comprised of a central hub portion and a plurality of curved arms radiating in the same direction from the hub.

The Parchmann design patent discloses a design for a barber's sign. The relevant portion of the deisgn consists of a globe having a plurality of painted curvilinear segments joined at the top and bottom of the globe. A conventional shaft located at the center-bottom of the globe allows the globe to rotate.

The Costanz design patent discloses an ornamental design for a lamp globe. The globe has an upper and a lower partial hemisphere where each hemisphere has a plurality of painted curvilinear segments joined at the top and bottom respectively and extending to a line near the diameter of the globe. The globe has an opening at the center of the lower hemisphere for the insertion of a light bulb.

DISCLOSURE OF THE INVENTION

The segmented geometric structure is designed for a plurality of uses and may be constructed in a variety of geometric shapes. Some of the structure's uses include display advertising, various types of visual effects with or without lights, functional mood setters, or as a static or rotatable object d'art.

The structure is comprised of a plurality of spirally formed curvilinear segments that are joined at their respective top and bottom joints to form a single rigid structure. The structure may take the shape of a spheroid, ellipsoid, or any geometric form amenable to a segmented construction. Whatever the shape, the structure is designed to be suspended by means of a line that is attached to the top of the structure. The other end of the line may then be attached to an elevated support which allows the structure to be rotated manually. Alternatively, a shaft may be attached to the top or bottom of the structure with the other end of the shaft attached to a reversible electrical motor whose direction of rotation is controlled by an electrical switch.

When the structure is rotated, either manually or by the motor, in a clockwise direction the segments appear to move spirally upwards creating a positive or "up" mood. Conversely, a counter-clockwise rotation produces a downward spiral which may be used to create or amplify a relaxing mood or a feeling of tranquillity.

The mood setting capability of the structure may be further enhanced by painting the segments in suggestive colors and design combinations. Additionally, a dynamic and relaxing shadow effect may be created by directing a light source onto the rotating surface of a structure that is suspended near a corner of a room.

The design of the curvilinear segments are derived by a novel set of mathematical equations that when solved produce a set of points that define the loci of the segment curve. The points, in turn, are plotted on a modified geodesic coordinate system marked on a construction spheroid form. The form serves as a construction method by which the structure may be manufactured. In this construction method a set of rigid segment guides are attached to the form alongside the points. A piece of segment material is then temporarily affixed to the top of the form and the material is brought down against the segment guides to form a segment. Other construction methods such as a two-piece mold onto which is poured the segment material in liquid form may also be used.

In addition to providing a segmented geometric structure that can be used in a variety of ways, it is also an object of the invention to produce a unit that:

- can be easily manufactured in a variety of sizes and shapes in a cost-effective manner,
- by application of a set of mathematical equations, used in combination with a modified geodesic coordinate system, the shape of the segments comprising the geometric structure can be explicitly defined,
- is virtually maintenance free.

BRIEF DESCRIPTION OF THE DRAWINGS

FIG. 4 is a non-symetrical side view of the spheroid segmented geometric structure having a base attachment shaft attached to its south pole where base is attached to a d-c motor housed within a mounting base.

FIG. 5 is a perspective view of an ellipsoid segmented geometric structure.

FIG. 6 is a perspective view of a mirror image conic section segmented geometric structure.

FIG. 7 is a partial perspective view showing a plurality of separate wind vanes attached to the segments.

FIG. 8 is a partial perspective view showing a set of segments in the shape of wind vanes.

BEST MODE FOR CARRYING OUT THE INVENTION

The best mode for carrying out the invention is comprised of a segmented geometric structure 10 configured as a spheroid 11 having a means to be rotated about its vertical axis. The basic aesthetic and functional description of the structure 10 is initially presented which is then followed by a description of how the curvilinear segments 12 that form the structure 10 are derived and lastly a description of two methods that may be employed to construct the structures.

Figure 1:
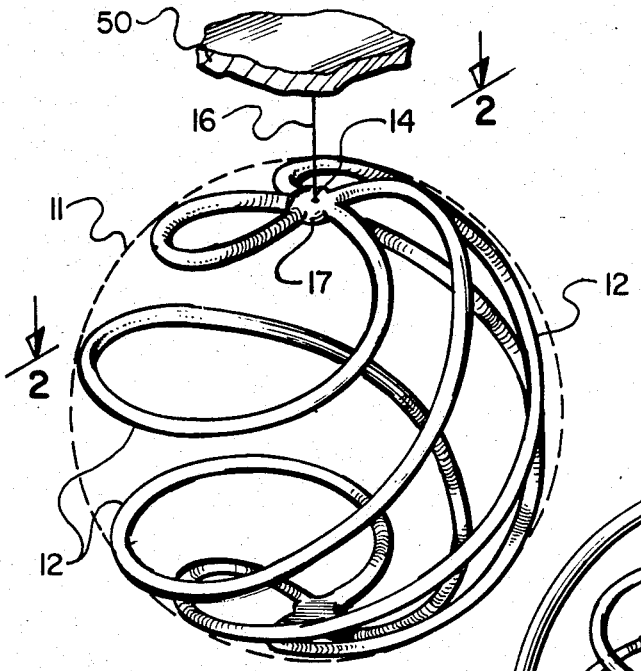
FIG. 1 is a perspective view of the spheroid segmented geometric structure shown suspended from an elevated support.
Figure 3:
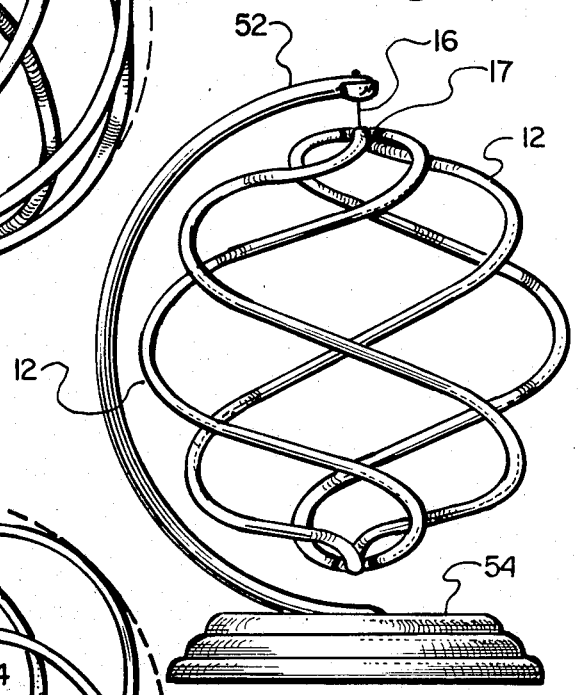
FIG. 3 is a symetric side view of the spheroid segmented geometric structure being suspended from a curved suspension member where lower end of member is attached to a support base.
Figure 2:
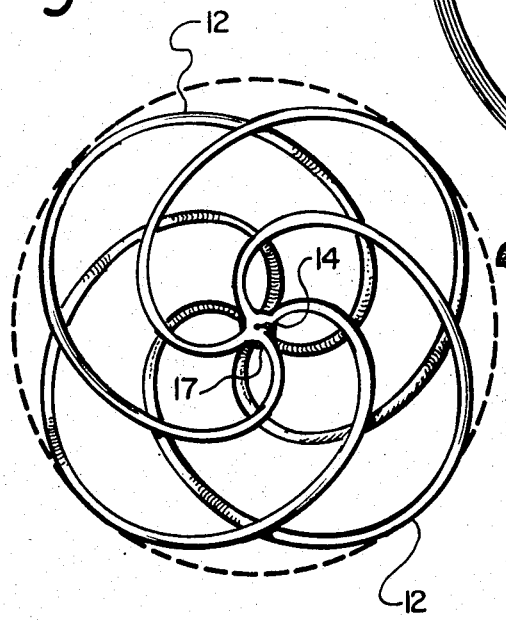
FIG. 2 is a cross sectional view taken along lines 2—2 of FIG. 1.

The segmented geometric structure in its spheroid 11 shape is shown in three of its mounting configurations in FIGS. 1, 3 and 4 and in a top view in FIG. 2. However, other shapes including an ellipsoid 13 as shown in FIG. 5 and a mirror image conic section 15 having identical upper and lower sections as shown in FIG. 6 may also be employed. In the following discussion reference is made to only the spheroid 11. The discussion however, is also applicable to the other geometric forms 13, 15.

The segmented geometric structure 10 in the shape of a spheroid 11 is comprised of a plurality of identically shaped curvilinear segments 12 that are spirally wound in either a clockwise or counter clockwise direction to fit around the surface of a construction spheroid form 40. The quantity of segments 12 may vary from one to a maximum quantity that is limited only by the space available. In general two to six segments, with four preferred, provide the most pleasing aesthetic structure. The top and bottom ends of the segments are conventionally joined at their respective top or north pole joining intersection and at their bottom or south pole joining intersection to thus form a single structure 10.

The curvilinear segments 12 in the preferred embodiment are constructed of round copper tubing that is subsequently chrome plated. However, other cross sectional shapes made from various plastics and wood may also be used. Where metal is used the segment junction at the north and south poles may be brazed or soldered; when plastic is used a plastic fusion or a compatible adhesive is used; and when the material is wood a glue is employed. Other segment joining methods that are well known in the art, such as stapling devices, may also be used.

The structure 10 is designed to be rotated about its vertical axis by suspending the structure from its north pole to an elevated support 50, as shown in FIGS. 1 and 3 or base mounted as shown in FIG. 4. To suspend the spheroid a small mounting hole 14 is drilled at the structures north pole junction 17. Through this hole is inserted a suspension line 16 made preferably of clear nylon or the like. The line 16 is pulled through the hole and a knot or other obstruction is affixed at its end inside the spheroid to prevent the line from slipping through the hole. If a hole is not used the line may be simply tied around the structure's north pole junction. The other end of the suspension line is then conventionally affixed to the elevated support 50 allowing the structure to be manually rotated. The elevated support 50 can be any surface, such as a ceiling, as shown in FIG. 1 or it may consist of a curved suspension member 52 having its lower end rigidly attached to a support base as shown in FIG. 3. In this second method the line 16 from the structure is attached to the upper end of the suspension member 52. When the structure is rotated clockwise the spheroid produces an upward spiral whereas when the spheroid is rotated counter clockwise a downward spiral is produced.

In the base mounted configuration, as shown in FIG. 4, an outwardly extending base attachment shaft 18 is conventionally attached to the south pole junction 19. The outer end of the shaft 18 is conventionally connected to the shaft of a reversable d-c electrical motor 20 housed within a mounting base 22.

When the spheroid is rotated by means of a motor the north and south poles may be aligned in their normal vertical axis or the structure may be mounted sideways with the north and south poles aligned horizontally.

Figure 9:
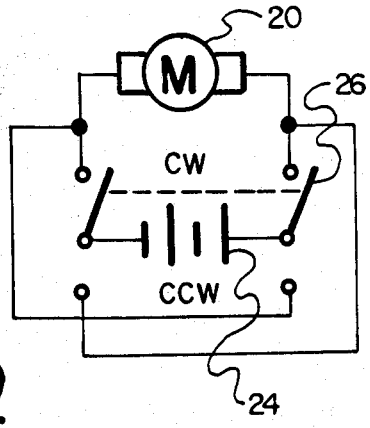
FIG. 9 is a schematic of the electrical circuit used to operate the d-c motor that rotates the segmented geometric structure as shown in FIG. 4.

The motor 20, as shown schematically with other electrical components in FIG. 9, is powered by a replaceable battery 24 that is also housed within the base 22. The power applied to the motor 20 is controlled by a three-position double-pole switch 26. When the switch is in the center OFF position, there is no power applied; when the switch is placed in the CW position the spheroid will turn clockwise; when the switch is placed in the CCW position, the polarity of the battery voltage to the motor is reversed causing the motor and spheroid to rotate in the counter-clockwise direction. The d-c motor may also be powered by a d-c power supply that is connected to public utility 115 volt a-c power.

An additional rotational method that may be employed is to attach a plurality of wind vanes 28 to the curvilinear segments 12 or to construct a segment 30 in the shape of a wind vane. A typical set of segments with the wind vanes 28 attached is shown in FIG. 7, while the segments shaped as wind vanes are shown in FIG. 8.

The direction of rotation may be selected to provide uplifting, tranquilizing and/or meditative mood settings. For example, when the structures 10 rotation is clockwise, the resulting upward spiral motion may be used to create a positive or "up" mood. Likewise, a counter-clockwise rotation which produces a downward spiral motion may be used to help create or amplify a relaxing mood or a feeling of tranquillity. Additionally, the curvilinear segments 12 may be constructed or painted in varying degrees or multiple colors to further enchance the mood setting capabilities of the structures.

The configuration of the segmented geometric structure 10, which is described in terms of, but not limited to a spheroid is dependent upon the quantity and shape of the curvilinear segments. For the purpose of illustration a segmented geometric structure 10 is described having a set of four curvilinear segments 12 where each segment makes one complete spiral from the top or north pole to the bottom or south pole of the spheroid 11.

Two sequential steps are necessary to achieve the required shape. The first is that the construction spheroid form 40 be marked with lines representing a modified geodesic coordinate system; the second that a set of equations be developed that provide a set of points that are used to plot the explicit shape of each of the four curvilinear segments 12 onto the surface of the spheroid form 40.

The modified geodesic coordinate system employs a north and south pole; longitude and latitude lines, and a reference equator line. In the spheroid's northern hemisphere a mark is placed that corresponds to the spheroid's north pole and likewise, a mark is placed in the spheroid's south pole. Around the diameter separating the northern and southern hemisphere a reference equator line is drawn that represents 0-degrees latitude. The equator line also has a reference mark that corresponds to 0-degrees and 360-degrees longitude.

In the northern hemisphere of the spheroid structure the longitude lines are numered from east to west from 0 to 360-degrees in 10-degree increments where 0 and 360-degrees coincide. Latitude lines are then drawn in 10-degree increments commencing at 0-degrees at the equator line to 90-degrees at the north pole.

In the southern hemisphere the geodesic coordinate system differs from the conventional system in that longitude lines are numbered in reverse from west to east from 0 to 360-degrees in 10-degree increments where 0 and 360-degrees coincide. Latitude lines are conventionally drawn in 10-degree increments commencing at 0-degrees at the equator and concluding at 90-degrees at the south pole.

After the modified geodesic coordinate system is in place, the shape of each of the four curvilinear segments 12 is plotted on the spheroid's surface. The shape of each segment is determined by a set of points that are derived by a set of four curve equations. Each equation, when solved, provides a set of points that explicity defines the loci of one of the segments. The set of equations developed for the preferred embodiment of the structure 10 are shown in Table I. In these equations $m=2$ which defines a curvilinear segment 12 that makes one complete spiral from the spheroid's north pole to the south pole. The equations are applicable for use on both the northern and souther hemispheres of the spheroid. Note that if $m=0$ each segment is a great circle extending from the north to the south pole. Likewise if $m=4$ each segment makes two complete spirals as it moves from the north to the south pole.

TABLE I

CURVILINEAR SEGMENT EQUATION SET

| Reference Starting Coordinates | | |
|---|---|---|
| Latitude | Longitude | Curve Equation |
| 0 | 0 | Longitude = m × latitude |
| 0 | 90 | Longitude = m × latitude + 90 degrees |
| 0 | 180 | Longitude = m × latitude + 180 degrees |
| 0 | 270 | Longitude = m × latitude + 270 degrees |

The segmented geometric structure 10 may be constructed by several methods. Two such methods are next described with the first method being preferred.

The preferred method applies to a structure 10 having a spheroid shape 11; four identical curvilinear segments 12; and the modified geodesic coordinate system previously described.

Figure 10:
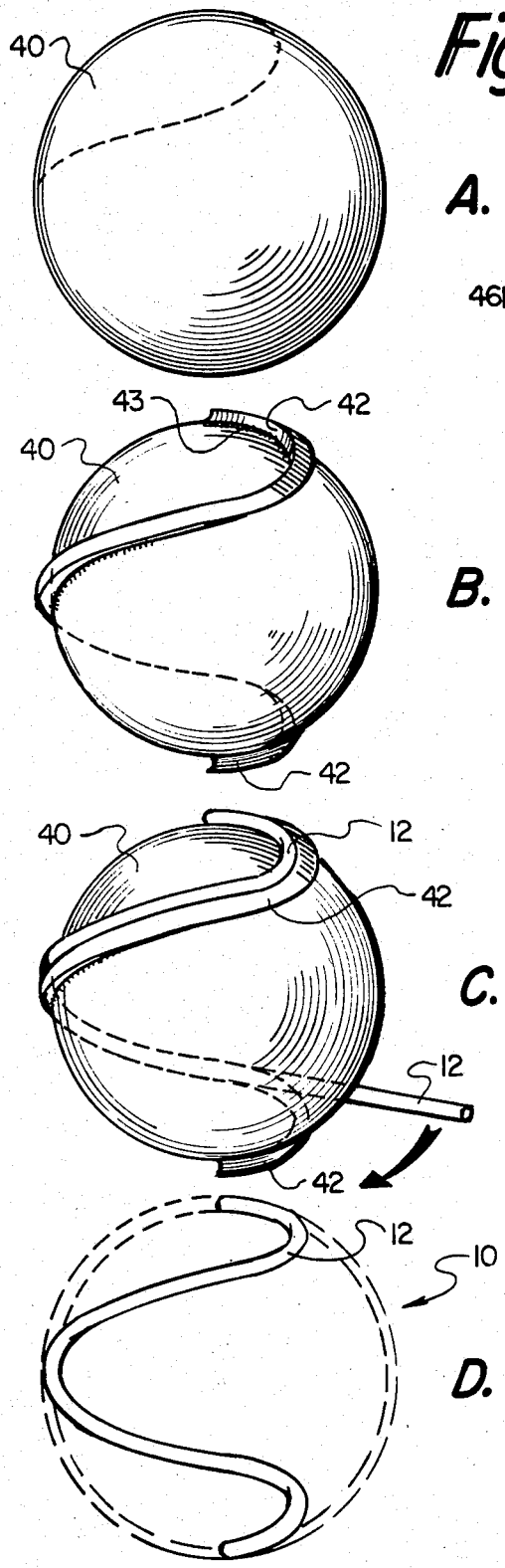
FIG. 10 illustrates the steps required to form a curvilinear segment on a construction spheroid form.

The first step in the construction, as shown in FIG. 10A, is to select a construction spheroid form 40 having the desired diameter. After the spheroid form is marked with the modified geodesic coordinate system determine the number of spirals each of the segments 12 is to make. In this discussion each of the basic four equations, listed in Table I, define a segment that makes one complete spiral as it rotates from the spheroid's north pole to its south pole.

The surface of the spheroid form 40 is then marked with a set of points **40*a* as also shown in FIG. 10A**, derived from the mathematical equations where the points define the shape of the selected curvilinear segment, in this case a segment making one complete spiral from the north pole to the south pole. The basic equations listed in Table I, have been solved and the required points to plot all four of the curvilinear segments are included in Table II. The $N^{th}$ segment is defined by a set of points comprised of latitude and longitude pairs. These points are derived by combining each latitude value, as shown in column one of Table II, in turn with the corresponding $N^{th}$ longitude value.

TABLE II

SET OF POINTS CORRESPONDING TO FOUR CURVILINEAR SEGMENTS

| | SEGMENT | | | |
|---|---|---|---|---|
| | 1 | 2 | 3 | 4 |
| Latitude | Longitude | Longitude | Longitude | Longitude |
| 0 | 0 | 90 | 180 | 270 |
| 10 | 20 | 110 | 200 | 290 |
| 20 | 40 | 130 | 220 | 310 |
| 30 | 60 | 150 | 240 | 330 |
| 40 | 80 | 170 | 260 | 350 |
| 50 | 100 | 190 | 280 | 370 |
| 60 | 120 | 210 | 300 | 390 |
| 70 | 140 | 230 | 320 | 410 |
| 80 | 160 | 250 | 340 | 430 |
| 90 | 180 | 270 | 360 | 450 |

A set of segment guides 42 having a guide edge 43 are next permanently attached to the spheroid form 40 as shown in FIG. 10B. The guide edge 43 lies perpendicular to the surface of the spheroid form alongside the points corresponding to the shape of each of the selected curvilinear segment 12.

One end of the segment material 12, as shown in FIG. 10C, is attached by conventional means to the north pole of the construction spheroid form 40. After attachment the material is bend around the first segment guide on the spheroid using the edge of the segment guide to guide the segment material around the spheroid form. When the material reaches the south pole it is cut and removed from the surface of the spheroid form as shown in FIG. 10D. The above step for each of the other three segments is repeated to obtain a total of four identical curvilinear segments. If plastic is selected for the segment material, it must first be heated until flexible. The flexible material is then clamped to the north pole and the flexible material is bent around the segment guides. The plastic is left to harden and is then removed from the form.

Each of the completed segments is then placed on a collapsible fixture (not shown) having the means to space each of the segments equally on the fixture. After the four segments are in place at their north and south poles respectively they are joined as previously described. The collapsible fixture is then collapsed and removed from the completed segmented structure.

The above described construction employed a method where one arm is formed in one process step where ultimately four single arms are produced for each structure 10. Other construction methods may also be used, for example:

Two Segment Are Formed In One Processing Step

1. Attach to the spheroid's north pole one end of the segment material and commence to form the first segment by bending the material downwardly.
2. When the segment reaches the spheroid's south pole bend the material upwardly and begin the next segment.
3. When the north pole is reached, stop bending and cut off the remaining segment material.
4. Repeat steps 1, 2 and 3 so that there are two separate pieces of material, each composed of two segments.
5. Rotate one of the segments by 180-degrees and join the ends of the segments at their respective north and south poles, as previously described, to form a single structure 10.

Four Segments Are Formed In One Processing Step

1. Attach to the spheroid's north pole one end of the segment material and commence to form the first segment by bending the material downwardly.
2. When the segment reaches the spheroid's south pole, bend the material upwardly and begin the second segment.
3. When you reach the north pole, once again bend the material downwardly and begin the third segment.
4. When you reach the south pole, once again bend the material upwardly and begin the fourth segment.
5. When the north pole is once again reached, stop bending and cut off the remaining segment material.
6. Remove material from the spheroid form by starting at one end of the rod and "peeling" it off the form (i.e., the plastic rod or metal tubing will be flexible enough to slip off the form without losing the shape of the curves.
7. Conventionally join the ends of the segments at their respective north and south poles, as previously described, to form a single structure 10.

There are many other construction methods that may be employed to construct a segmented geometric structure 10. For example, a mechanism and process (not illustrated) can easily be developed that uses heated extruded plastic to form the curvilinear segments 12 of the structure 10. In this method the plastic is caused to flow onto the sides of the segment guide 42 which are located on a slowly rotating spheroid form 40. Upon completion of the required number of spheroid rotations, the spheroid form 40 is stopped and the completed structure is removed from the form.

Figure 11:
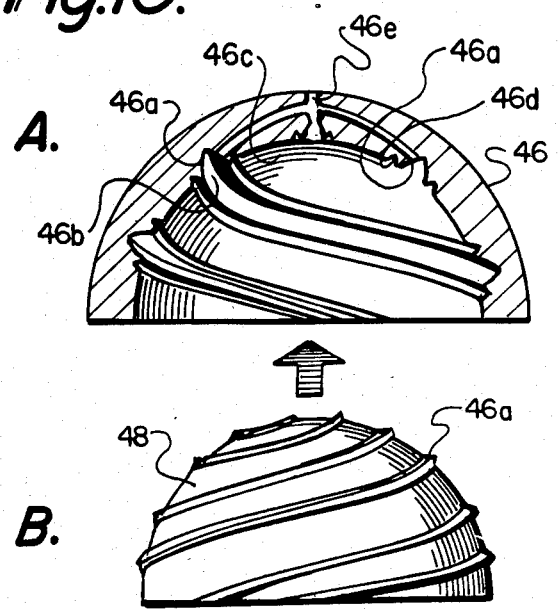
FIG. 11 shows a convex and concave mold used to construct one hemisphere of a curvilinear segment.

Another construction method employs a two-piece mold, as shown in FIG. 11, where one piece is a concave mold 46 and the other, a mating convex mold 48 that precisely fits into the concave opening. Both molds are in the shape of a spheroid hemisphere.

The concave mold has on its inside surface a set of channels 46*a* that are in the shape of a triangle with one of the triangles flat side 46*b* being in the same plane as the molds inner surface 46*c*. The channels are configured to correspond to the shape and quantity of the curvilinear segments 12 that would be included on either an upper or lower hemisphere of a spheroid. Additionally, in the preferred embodiment of this method the triangular channels include on each side a mold alignment and locking key 46*d* that extends throughout the length of the channels. The concave mold 46 is also designed to have one or more pouring bores 46*e* that are in optimum pouring placement with respect to the segment channels 46*a*.

The convex mold 48 has a corresponding set of mold alignment and locking keys 48*a* that precisely fit into the keys 46*d* of the concave mold 46. The key set 46*d*, 48*a* allows the two molds to be accurately aligned and fitted prior to the pouring sequence.

A second embodiment of this method (not shown) uses a concave mold that has a set of triangular channels that do not incorporate a mold alignment and locking key. In this arrangement, the convex mold has a smooth, flat outer surface that is sized to tightly and precisely fit into and abutt with the inner surface of the concave mold. Thus, the surface of the convex mold provides the sole backing for the flat side of the triangular channels.

Figure 12:
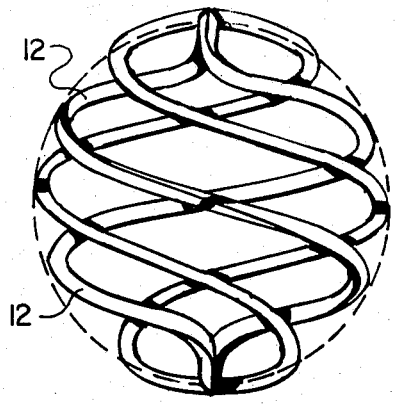
FIG. 12 shows the two completed hemispheric segments joined together to form a completed segmented geometric structure.

When the concave and convex molds 46, 48 are joined in their proper alignment the curvilinear segment 12 material, in liquid form, is poured into the pouring bores 46*d*. When the liquid has hardened the molds are separated and one-half of a segmented geometric structure 10 is removed. When two of these halves are joined, by conventional means, a completed single structure 10 is made as shown in FIG. 12.

While the invention has been described in complete detail and pictorially shown in the accompanying drawings, it is not to be limited to such details, since many changes and modifications may be made to the invention without departing from the spirit and the scope thereof, for example, various materials may be used to construct the curvilinear segments and the segments may be painted in a multitude of color combinations and designs to provide an assortment of visual effects. Additionally, assemblages of structures may be created in which multiple structures are combined to form a single product. Such products would include mobiles and assemblies in which one structure is placed inside a larger structure. The structure may also have lights mounted within the structure or a light may be mounted on the base. Such lights would further enhance the mood creating capability and aesthetics of the invention. Hence, it is described to cover any and all modifications and forms which may come within the language and scope of the claims.

I claim:

1. A segmented geometric structure comprising a plurality of spirally formed curvilinear segments where the top and bottom end of each said segment is respectively joined to form a single structure where said structure has a vertical axis projecting from the top joint or north pole junction and the bottom joint or south pole junction.

2. The structure as specified in claim 1 wherein said structure is in the shape of a spheroid.

3. The structure as specified in claim 1 wherein said structure is in the shape of an ellipsoid.

4. The structure as specified in claim 1 wherein said structure is comprised of a mirror image conic section having an upper section and an identical lower section.

5. The structure as specified in claim 1 wherein all of said curvilinear segments are identically shaped.

6. The structure as specified in claim 1 wherein said structure has a means to allow said structure to be rotated about its vertical axis.

7. The structure as specified in claim 6 wherein said means to rotate said structure is accomplished by having a mounting bore at said north pole junction of said curvilinear segments into which is inserted a suspension line that is conventionally held at the junction and where the other end of said line is affixed to an elevated support allowing said structure to be manually rotated in either a clockwise or counter clockwise direction.

8. The structure as specified in claim 7 wherein said elevated support is further comprised of a curved suspension member having a lower end and an upper end where said lower end is rigidly attached to a support base and where said suspension line from said structure is attached to said upper end.

9. The structure as specified in claim 6 wherein said means to rotate said structure is accomplished by conventionally attaching an outwardly extending base attachment shaft at either of said poles where said shaft is then conventionally attached to the shaft of a base mounted electrical motor.

10. The structure as specified in claim 1 wherein said curvilinear segments have a plurality of wind vanes attached that provide a wind resistance that causes said structure to rotate when wind strikes said wind vanes.

11. The structure as specified in claim 5 wherein the shape of said curvilinear segment is derived by rotating a generating curve around the vertical axis of a spheroid form where said curve is derived by employing a modified geodesic coordinate system in combination with a set of mathematical equations.

12. The structure as specified in claim 11 wherein said modified geodesic coordinate system as applied to said spheroid form employs:

(a) a north pole,
(b) a south pole,
(c) a reference equator line and
(d) longitude and latitude lines where:
  (1) in the northern hemisphere of said spheroid form said longitude lines are numbered from east to west from 0 to 360-degrees in 10-degree increments and said latitude lines are drawn in 10-degree increments commencing at 0-degrees at said equator line to 90-degrees at said north pole; and
  (2) in the southern hemisphere said longitude lines are numbered from west to east from 0 to 360-degrees in 10-degree increments and said latitude lines are drawn in 10-degree increments and said latitude lines are drawn in 10-degree increments commencing at 0-degrees at said equator line to 90-degrees at said south pole.

13. The structure as specified in claim 11 wherein said set of mathematical equations are comprised of the following four equations:

(a) longitude=m×latitude
(b) longitude=m×latitude+90-degrees
(c) longitude=m×latitude+180-degrees
(d) longitude=m×latitude+270-degrees where when m=2 said segment makes one complete spiral from said north to said south pole of said spheroid form and when m=4 said segment makes two complete spirals as said segment moves from said north to said south pole.

14. A method for constructing a spheroid segmented geometric structure having four curvilinear segments where said method comprises the following (a) select a construction spheroid form having the desired diameter,
(b) place a mark on said spheroid forms north pole, south pole and draw a reference equator line around said diameter of said form,
(c) mark the surface of said form with a modified geodesic coordinate system where:
  (1) longitude is numbered from 0 to 360-degrees around said equator line: east to west in northern hemisphere and west to east in southern hemisphere,
  (2) latitude is numbered from 0 to 90-degrees where 0-degrees is located on said equator line and 90-degrees is located at said north and south poles of upper and lower hemisphere respectively,
(d) determine the number of spirals each of said segments is to make and select a set of mathematical equations corresponding to the number of spirals—in this construction each said segment will make one complete spiral as it rotates from said north pole to said south pole which corresponds to the following set of mathematical equations:
  (1) longitude=2×latitude
  (2) longitude=2×latitude+90-degrees
  (3) longitude=2×latitude+180-degrees
  (4) longitude=2×latitude+270-degrees
(e) mark surface of said spheroid from with a series of points derived from the set of mathematical equations,
(f) attach to said spheroid form by a permanent means, a segment guide having an edge that lies perpendicular to the spheroid surface and is fitted alongside the series of points corresponding to the shape of said curvilinear segment,
(g) select a length of segment material,
(h) conventionally attach one end of said segment material to the north pole of said spheroid
(i) bend said segment material around said spheroid form using the edge of said segment guide to guide the segment material around said spheroid form,
(j) cut the segment material when the south pole on said spheroid form is reached and remove said segment material from said spheroid form,
(k) repeat steps g, h, i, and j three additional times to obtain a total of four said curvilinear segments,
(l) place each of said four segments on a collapsible fixture that has the means to space each of said segments equally,
(m) after the four said segments are in place permanently join each of said four segments at their north and south poles respectively,
(n) collapse said collapsible fixture and remove same from the completed segmented structure.

15. A method for constructing a segmented geometric structure having a spheroid shape and four curvilinear segments where said method comprises the following steps:

(a) secure a concave mold in the shape of a spheroid hemisphere where said mold has a set of channels on its inner surface corresponding to the required shape and quantity of curvilinear segments that would be included on either an upper or lower hemisphere of said segmented geometric structure and with said concave mold having one or more pouring bores that are in optimum pouring placement with respect to said channels, (b) secure a convex mold that is sized to precisely fit into and abutt with the inner surface of said concave mold, (c) place and align said concave mold over said convex mold, (d) pour into said pouring bores on said concave mold a liquified segment material, (e) when said liquid segment material has hardened separate said molds and remove the hardened said structure which constitutes one-half of a completed segmented geometric structure, (f) repeat steps c, d, and e, and (g) join said two halves, by conventional means, to form a completed single said segmented geometric structure.

* * * * *